US006887187B1

(12) United States Patent
Renz

(10) Patent No.: US 6,887,187 B1
(45) Date of Patent: May 3, 2005

(54) CONVERTIBLE EXERCISE EQUIPMENT

(76) Inventor: Bradley R. Renz, 59141 Bremen Hwy., Mishawaka, IN (US) 46544

( * ) Notice: Subject to any disclaimer, the term of this patent is extended or adjusted under 35 U.S.C. 154(b) by 80 days.

(21) Appl. No.: 10/429,415

(22) Filed: May 5, 2003

(51) Int. Cl.[7] ..... A63B 69/16
(52) U.S. Cl. ..... 482/57; 482/60; 482/910
(58) Field of Search ..... 482/51, 57, 60, 482/91, 121, 122, 124–126, 148, 908, 910

(56) References Cited

U.S. PATENT DOCUMENTS 2,832,595 A * 4/1958 Hastings ..... 482/131
3,606,321 A * 9/1971 Macoulis ..... 482/122
3,982,756 A * 9/1976 Hersey et al. ..... 482/131
4,060,240 A * 11/1977 Dunston ..... 482/131
5,407,411 A * 4/1995 Trainor ..... 482/95
5,788,608 A * 8/1998 Wilkinson ..... 482/51
6,228,004 B1 * 5/2001 Steinbach et al. ..... 482/121

* cited by examiner

*Primary Examiner*—Nicholas D. Lucchesi
*Assistant Examiner*—Tam Nguyen

(57) ABSTRACT

An apparatus used for exercising includes a shaft with a crossbar mounted at one end. A pair of stirrups connected by a cord are trained about a pulley which is carried by the crossbar. The apparatus may be used for simulating a bicycle-like motion by placing one's feet in the stirrups while sitting down and alternatingly pumping the back and forth in the stirrups. A second handle and carrying case complete the apparatus such that when the crossbar and pulley are removed from the shaft the handle may be removably attached to the same end and the shaft then used as a walking assist device. The crossbar, pulley, and stirrups may then be stored in the carrying case.

5 Claims, 4 Drawing Sheets

CONVERTIBLE EXERCISE EQUIPMENT

FIELD OF THE INVENTION

The invention disclosed herein relates to personal exercise equipment and a method of using the same.

BACKGROUND OF THE INVENTION

With the increasingly sedentary nature of American culture, it has become more necessary for persons to go out of their way to exercise in order maintain their overall health. With this need, a multitude of various pieces of exercise equipment have been produced, ranging from simple dumbbells to highly complicated treadmills, bicycles, and other types of exercise equipment. A problem with many of these exercise devices is that they are bulky and, in general, difficult to carry around. For a person on the go, however, it would be desirable to have a piece of exercise equipment that is small and easily portable. Furthermore it would be desirable if the piece of exercise equipment could be used at times for activities other than exercises.

SUMMARY OF THE INVENTION

The invention disclosed herein includes an apparatus for facilitating the exercise of a person's muscles and cardiovascular system. The apparatus includes a shaft with a crossbar attachable to one end of the shaft. A pulley connectable at the crossbar carries a pair of stirrups connected by a cord, with the cord trained about the pulley. The stirrups may thereby be alternatingly reciprocated in a generally up and down movement on the cord about the pulley.

The exercise apparatus described above can be used by placing both feet in the stirrups while sitting on a chair, gripping the crossbar with one's hands while the opposite end of the shaft is braced against the floor, and alternatingly reciprocating the feet in the stirrups in a bicycling type motion.

One object of the invention is to provide a piece of exercise equipment that is easily portable. Another object of the invention is to provide a piece of exercise equipment that can be used in many varied settings. A further object of the invention is to provide a piece of exercise equipment that can have non-exercise related uses in conjunction with its exercise related uses.

BRIEF DESCRIPTION OF THE DRAWINGS

These and other aspects of the invention will be apparent from the following description, with reference to the accompanying drawings, in which.

DETAILED DESCRIPTION

Figure 1:
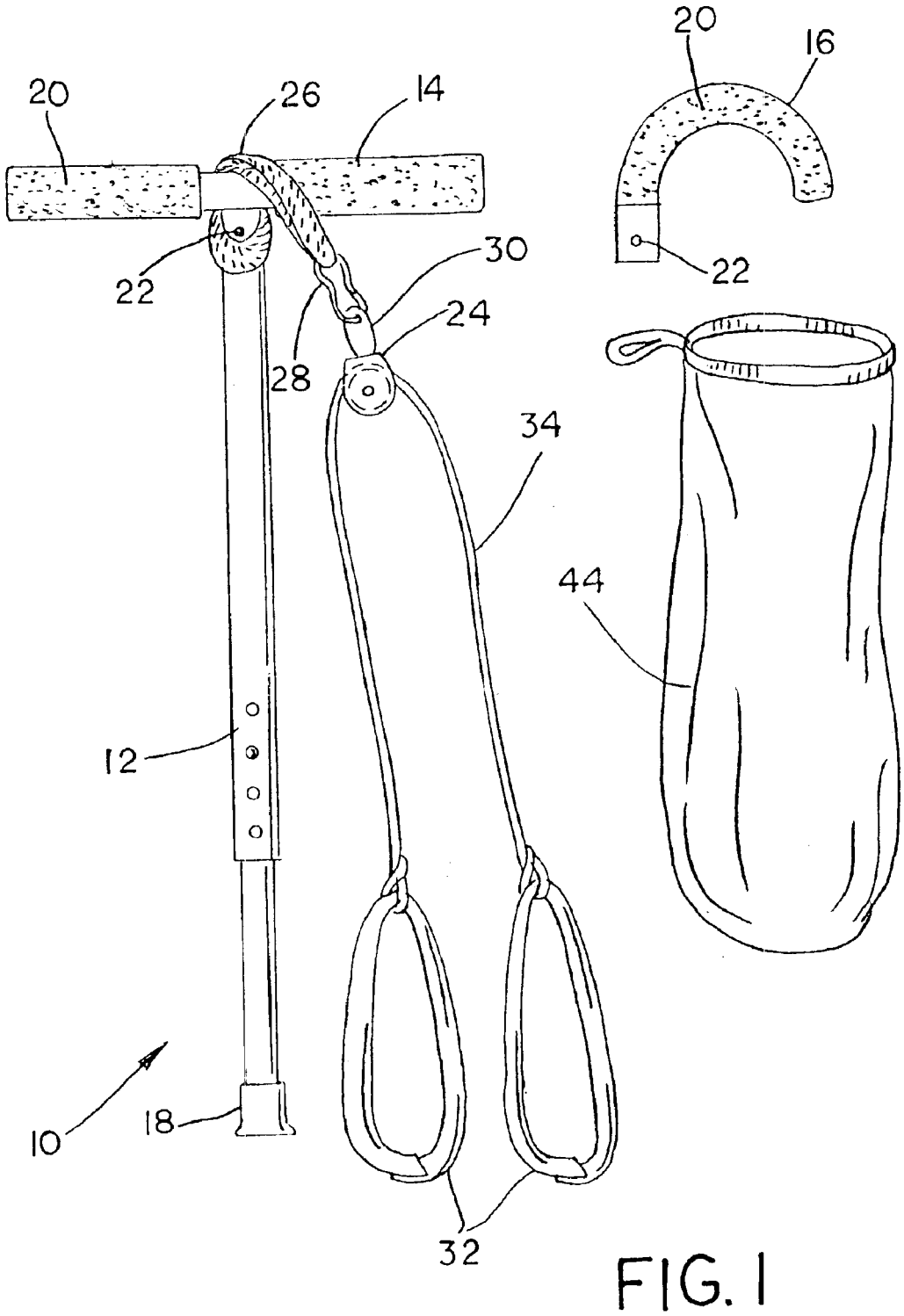
FIG. 1 shows the apparatus assembled for use as exercise equipment.
Figure 2:
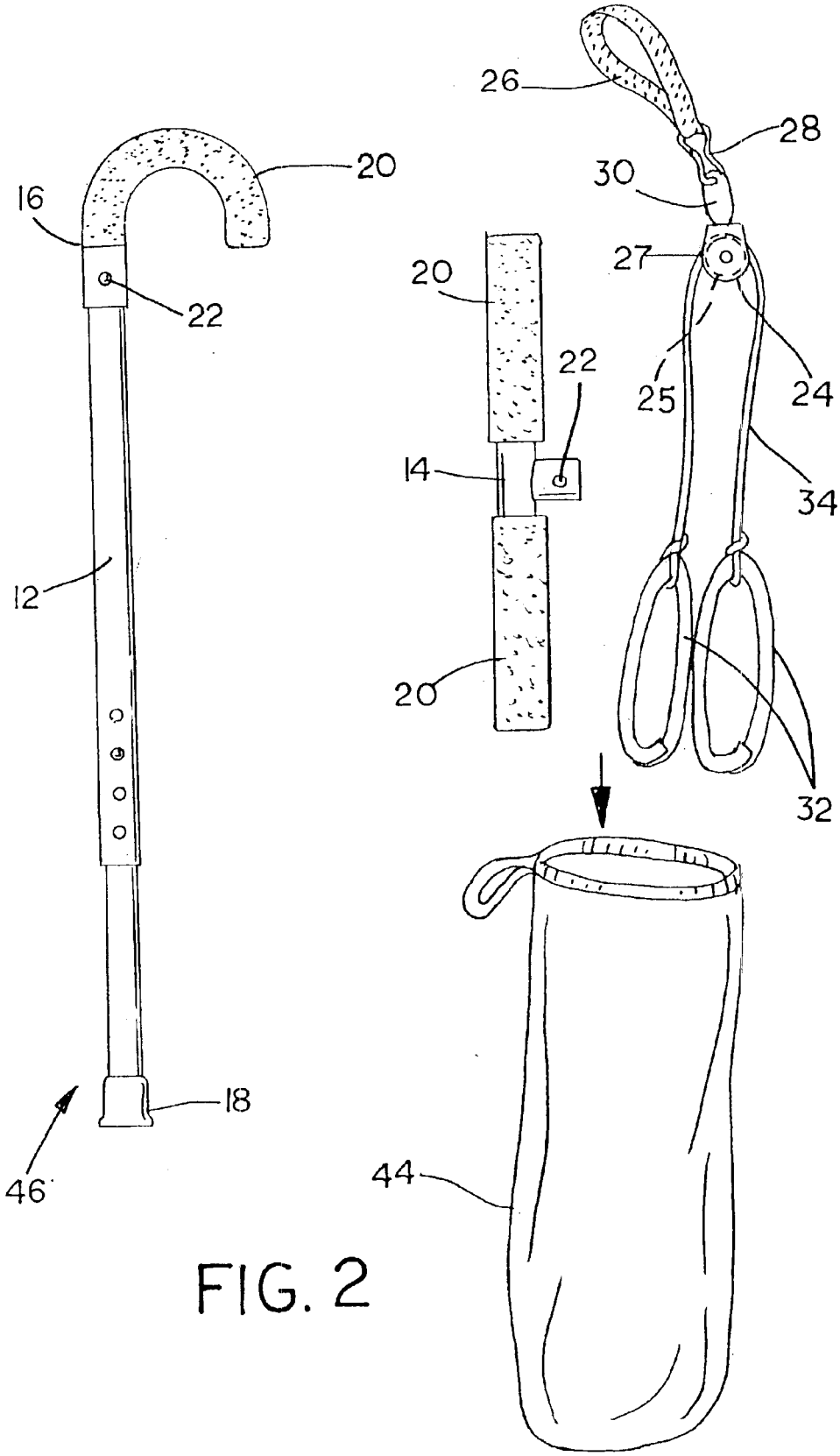
FIG. 2 shows the apparatus of FIG. 1 assembled as a walking stick.

Referring now to the embodiment depicted in the drawings, a convertible exercise apparatus 10 includes a shaft 12, a detachable crossbar 14 and a detachable cane handle 16. Shaft 12 is shown as telescoping and may utilize any known telescoping technology such as, for example, a press-release, snap fit locking system or a twist-frictional locking system. Preferably, shaft 12 can releasably maintain various lengths. A rubber end piece 18 mounted on the lower or foot end of shaft 12 prevents unwanted slipping of the shaft during use. At the opposite end of shaft 12, a cane handle 16 or any other type of grip assembly is releasably attached to the upper end of the shaft by any suitable releasable attachment mechanism 22 known. Crossbar 14 includes a similar attachment mechanism in the middle portion of the crossbar to allow it to be detachably attached to the end of shaft 12 when handle 16 is not so attached. Crossbar 14 and handle 16 both preferably include a grip material 20 to facilitate easy gripping by the user.

With crossbar 14 attached to shaft 12 at connection mechanism 22, pulley 24 is mounted about the intersection of shaft 12 and crossbar 14 by sliding a looped mounting strap 26 up the length of the shaft and draping the supported pulley over the crossbar. Pulley 24 is attached to mounting strap 26 by a detachable lock ring 28 carried by the strap, which is connected to a swivel mount 30 carried by pulley 24. The wheel 25 of pulley 24 is preferably journalled to the pulley housing 27 so as to accommodate high-speed rotation of the wheel. A pair of stirrups 32 are connected by a cord 34. Cord 34 is trained about pulley wheel 25 with the cord being carried by the pulley. Stirrups 32 should be sized to easily accommodate the feet of the user inserted through the stirrups. Cord 34 should be of a length to facilitate the bicycle type exercise hereinafter described.

Figure 3:
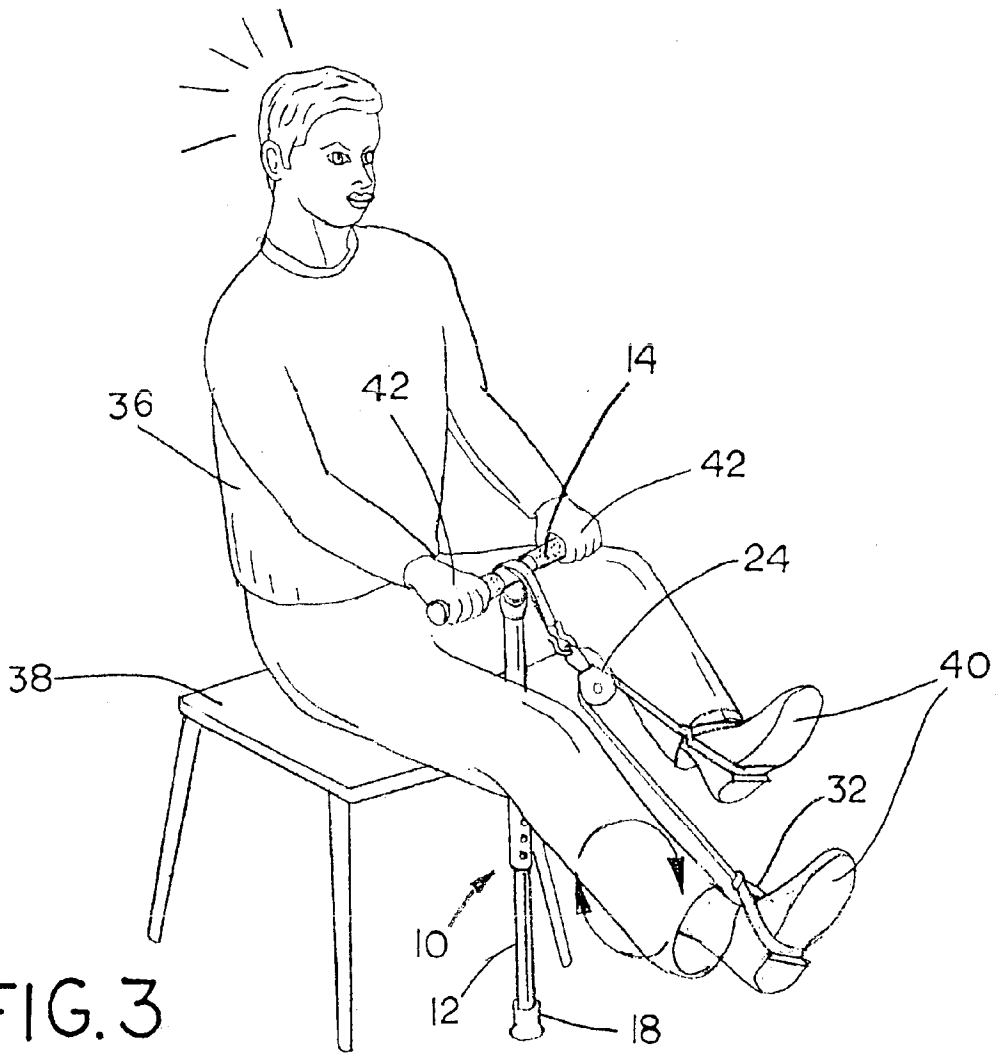
FIG. 3 shows a person using the apparatus for cardiovascular exercise.

Although the exercise apparatus described herein may be used for any variety of exercises, the following two exercises are considered to be preferred. In the first exercise the apparatus is used to simulate a bicycling motion with the legs as depicted in FIG. 3. This is accomplished by first assembling the apparatus with the crossbar 14 attached to shaft 12 and the pulley 24 mounted about the intersection of the crossbar and shaft as heretofore described. The length of shaft 12 is then adjusted so that the person 36 using the apparatus may comfortably sit on a chair or on a bench 38 with his or her feet 40 placed in both stirrups 32 while gripping crossbar 14 with both hands 42 and placing the lower end of the shaft on the floor. Exercise apparatus 12 should be so placed and adjusted such that when one leg is extended and the other retracted, the extended leg is bent at the knee so as to simulate a bicycle position. User 36 then reciprocates his or her legs and feet 40 back and forth in up and down alternating fashion similar to a bicycle pedaling motion. In performing such an exercise, the user 36 can quickly accelerate the user's heart rate, thereby obtaining a cardiovascular workout. The bicycling effort can easily be adjusted by varying the angle of the shaft 12 with respect to the ground. Maintaining the shaft 12 in a generally vertical orientation generally decreases the amount of effort required in the pedaling motion. Maintaining the shaft 12 at a greater angle away from the body tends to increase the pedaling effort required and also exercises the arm and back muscles more strenuously.

Figure 4:
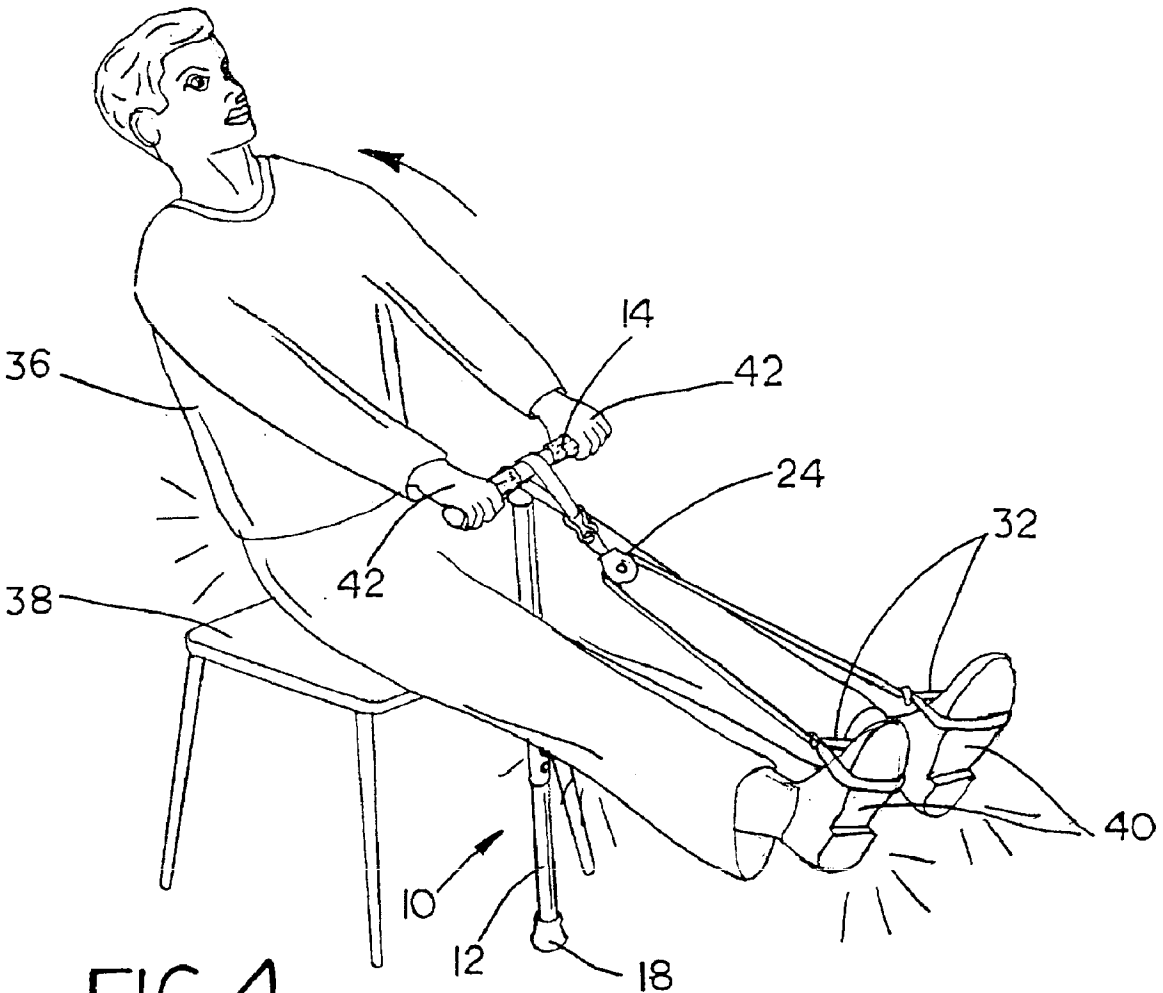
FIG. 4 shows a person using the apparatus for isometric exercises.

In a second exercise depicted in FIG. 4, shaft 12, crossbar 14, and stirrups 32 are used in an isometric exercise to stretch and exercise the leg and torso muscles of the user 36. In this exercise, the user 36 again sits on a seat 38 with the lower end 18 of shaft 12 placed against the floor while holding onto the crossbar 14 with his or her hands 42 and maintaining both feet 40 in stirrups 32. The apparatus 10 is adjusted such that the user's legs are both fully extended against the stirrups with the user's arms generally extended. Stirrups 32 are placed near the toes of the feet with the legs fully extended. The user 36 then gently pulls the crossbar 14 towards the user's torso thereby stretching the achilles tendons and associated leg muscles while at the same time exercising the torso and arm muscles. Of course, all of these exercises should be performed in a manner consistent with a physician's recommendation and using correct exercise techniques to prevent injury.

When person 36 is finished exercising, apparatus 10 may be completely broken down by disconnecting the crossbar 14 from the shaft 12 and removing the pulley 24 and stirrups 32 from the crossbar. The crossbar 14, shaft 12, handle portion 16, pulley 24, and stirrups 32 may all be conveniently stored in carrying case 44. Alternatively, crossbar 14, pulley 24, and stirrups 32 may be stored in carrying case 44 while handle 16 is reattached to shaft 12, thereby forming a walking stick or cane 46. The length of shaft 12 may be adjusted to a comfortable length using the adjustment mechanism. The user may then easily carry the crossbar 14, pulley 24, and stirrups 32 in carrying case 44 while using the walking stick 46 for walking.

The above description is only meant to exemplify the invention to enable others to reproduce it. The description is not intended to be a limitation from other minor and obvious variations on the embodiments described, all of which variations are expressly included herein.

I claim:

1. An apparatus for facilitating exercise of muscles and cardiovascular system of a person, said apparatus comprising:

a shaft having upper and lower ends;

a cross-bar releasably attached to said shaft;

a pulley releasably attached to said cross-bar; and a pair of stirrups connected to each other by a cord, said cord trained about said pulley, and a looped mounting strap attached to said pulley, said strap removably looped about said shaft and carried over said cross bar at intersection of said cross bar and said shaft; and a swivel mount on said pulley attached to said mounting strap such that said pulley may swivel in relation to said mounting strap, whereby said person when sitting may manually grip said cross-bar with the shaft lower end contacting a support surface and with each of said person's foot fitting into a stirrup such that said stirrups may be alternately reciprocated about said pulley.

2. An apparatus for facilitating exercise of muscles and cardiovascular system of a person, said apparatus comprising:

a shaft having upper and lower ends;

a crossbar releasably attached to said upper end of said shaft;

a pulley releasably attached to said crossbar;

a pair of stirrups connected to each other by a cord, said cord trained about said pulley, whereby said person when sitting may manually grip said crossbar with the shaft lower end contracting a support surface and with each of said person's foot fitting in a stirrup such that said stirrups may be alternately reciprocated about said pulley; and a walking assist grip releasably attachable to said upper end said shaft when said crossbar is detached from the shaft to facilitate use of said apparatus as a walking assist device.

3. The apparatus of claim 2 further comprising a releasable sliding lock disposed on at least one of said shaft and said cross-bar whereby the distance between said cross-bar and said lower end of the shaft may be selectively varied.

4. The apparatus of claim 2 further comprising a carrying case for carrying said apparatus when said shaft, cross-bar, and pulley are detached from each other.

5. A method of exercising muscles of a person utilizing an apparatus comprising a shaft having upper and lower ends, a crossbar releasably attached to said shaft with said cross-bar being releasably attachable to said upper end of the shaft, a pulley releasably attached to said crossbar, a pair of stirrups connected to each other by a cord, said cord trained about said pulley, whereby said person when sitting may grip said crossbar with hands with said shaft lower end contacting a support surface and each foot of the user fitting into a said stirrup such that the stirrups may be alternatively reciprocated about said pulley, and a walking assist grip releasably attachable to said upper end of said shaft when said crossbar is detached from the shaft to facilitate use of the apparatus as a walking assist device and a releasable sliding lock disposed on at least one of said shaft and said crossbar whereby the distance between the crossbar and said lower end of the shaft may be selectively varied, said method of exercising the steps:

(a) adjusting said shaft to a suitable length for performing the following exercise;

(b) sitting in a chair with both feet placed in said stirrups while gripping said cross-bar with both hands with the lower end of said shaft braced against said support surface; and, (c) alternatingly reciprocating said feet in a bicycling motion against said stirrups.

* * * * *